US008875747B2

(12) United States Patent
Gielen

(10) Patent No.: US 8,875,747 B2
(45) Date of Patent: Nov. 4, 2014

(54) GRIPPER HEAD FOR THE INSERTION OF WEFT THREADS ON A GRIPPER WEAVING MACHINE

(75) Inventor: Markus Gielen, Lindau (DE)

(73) Assignee: Lindauer DORNIER Gesellschaft mbH, Lindau (DE)

( * ) Notice: Subject to any disclaimer, the term of this patent is extended or adjusted under 35 U.S.C. 154(b) by 52 days.

(21) Appl. No.: 13/878,309

(22) PCT Filed: Sep. 15, 2011

(86) PCT No.: PCT/EP2011/066036

§ 371 (c)(1),
(2), (4) Date: Apr. 8, 2013

(87) PCT Pub. No.: WO2012/065768

PCT Pub. Date: May 24, 2012

(65) Prior Publication Data

US 2013/0199659 A1 Aug. 8, 2013

(30) Foreign Application Priority Data

Nov. 18, 2010 (DE) ..... 10 2010 044 127

(51) Int. Cl.

| | |
|---|---|
| ***D03D 47/28*** | (2006.01) |
| ***D03D 47/30*** | (2006.01) |
| ***D03D 47/23*** | (2006.01) |
| *D03D 23/00* | (2006.01) |

(52) U.S. Cl.

CPC ..... *D03D 47/23* (2013.01)
USPC ..... 139/448; 139/116.2; 139/444; 139/435.1

(58) Field of Classification Search

CPC . D03D 47/23; D03D 47/3033; D03D 47/304; D03D 2700/1495; D03D 47/20; D03D 47/236; D03D 47/271; D03D 47/30; D03D 47/302; D03D 47/308; D03D 51/085; D03D 51/34; B65H 2701/31

See application file for complete search history.

(56) References Cited

U.S. PATENT DOCUMENTS

| | | | | |
|---|---|---|---|---|
| 3,662,785 | A * | 5/1972 | Kokkinis | 139/448 |
| 3,805,850 | A * | 4/1974 | Van Duynhoven et al. | 139/1 E |
| 4,501,008 | A * | 2/1985 | Rosseel et al. | 377/2 |

(Continued)

FOREIGN PATENT DOCUMENTS

| | | |
|---|---|---|
| DE | 1 710 292 | 10/1971 |
| DE | 102 52 053 | 6/2004 |

(Continued)

OTHER PUBLICATIONS

International Search Report of the International Searching Authority for International Application PCT/EP2011/066036, mailed Feb. 19, 2013, 2 pages, European Patent Office, HV Rijswijk, Netherlands.

(Continued)

*Primary Examiner* — Bobby Muromoto, Jr.
(74) *Attorney, Agent, or Firm* — W. F. Fasse

(57) ABSTRACT

A gripper head for the insertion of weft threads on a gripper weaving machine as well as a gripper weaving machine with such a gripper head. The gripper head thread clamp for the weft thread is controlled in a contact-free manner and with high transfer reliability of the weft thread even in the machine center.

15 Claims, 12 Drawing Sheets

(56) References Cited

U.S. PATENT DOCUMENTS

Figure 1:
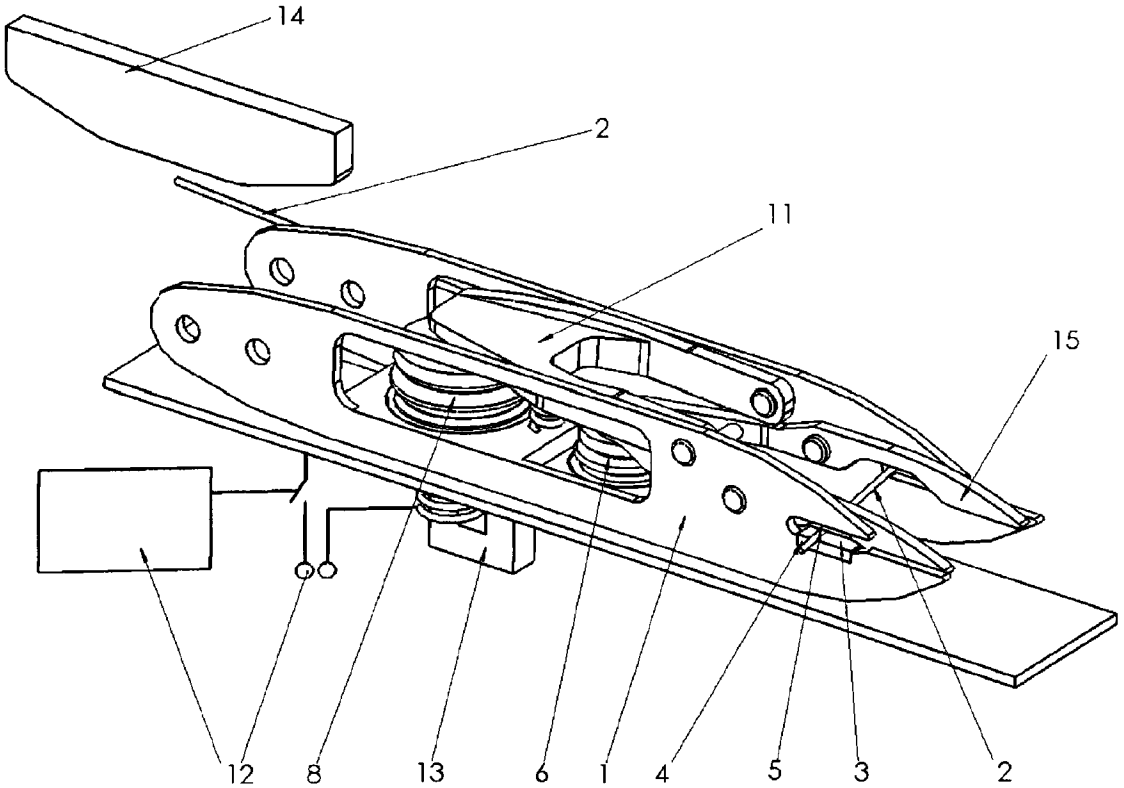

| | | | | | |
|---|---|---|---|---|---|
| 5,012,844 | A | * | 5/1991 | Griffith | 139/452 |
| 5,159,822 | A | * | 11/1992 | Schmid et al. | 66/126 R |
| 5,226,458 | A | * | 7/1993 | Bamelis | 139/194 |
| 5,303,746 | A | * | 4/1994 | Wahhoud et al. | 139/435.2 |
| 5,343,898 | A | * | 9/1994 | Fredriksson | 139/450 |
| 5,423,355 | A | * | 6/1995 | Greger et al. | 139/450 |
| 5,816,296 | A | * | 10/1998 | Schuster | 139/450 |
| 6,014,991 | A | * | 1/2000 | Teufel | 139/370.2 |
| 6,164,342 | A | * | 12/2000 | De Jager et al. | 139/448 |
| 6,497,257 | B1 | * | 12/2002 | Allen et al. | 139/450 |
| 7,275,291 | B2 | * | 10/2007 | Josefsson | 28/240 |
| 7,543,610 | B2 | * | 6/2009 | Klaui et al. | 139/452 |
| 7,726,351 | B2 | * | 6/2010 | Puissant et al. | 139/435.1 |
| 2013/0199659 | A1 | * | 8/2013 | Gielen | 139/448 |

FOREIGN PATENT DOCUMENTS

| | | |
|---|---|---|
| EP | 0 984 089 | 3/2000 |
| GB | 2 059 455 | 4/1981 |
| WO | WO2010142446 | 12/2010 |

OTHER PUBLICATIONS

PCT International Preliminary Report on Patentability including English Translation of PCT Written Opinion of the International Searching Authority for International Application PCT/EP2011/066036, issued May 21, 2013, 7 pages, International Bureau of WIPO, Geneva, Switzerland.

* cited by examiner

A - A

B - B

B - B

B - B

GRIPPER HEAD FOR THE INSERTION OF WEFT THREADS ON A GRIPPER WEAVING MACHINE

The present invention relates to a gripper head for the insertion of weft threads on a gripper weaving machine as well as a gripper weaving machine with such a gripper head.

Gripper weaving machines are known in the prior art, in which a weft thread is transported by a first gripper from one side of the weaving machine through the loom shed over half of the weaving width to the machine center, and there is transferred to a second gripper. The second gripper transports the weft thread through the loom shed over the second half of the weaving width to the other side of the weaving machine.

For example, the DE 1710292 A1 shows grippers with such gripper heads. This describes a pair of gripper heads consisting of a bringer-gripper and a taker-gripper, with which weft threads are inserted into a loom shed. The grippers consist of a gripper head and a gripper or rapier rod, which are alternately slidingly advanced into the loom shed and pulled back respectively by a transmission. Gripper heads are used, which hold the weft thread with thread clamps. A thread clamp consists of a stationary and a movable clamping part. The movable clamping part is embodied as a clamping lever and is pressed by a force onto the stationary clamping part. The force is applied by means of a spring mounted in the gripper head. By control devices on the weaving machine, the movable clamping part, that is to say the clamping lever, is opened or closed in the running weaving operation. Thereby a grasping or releasing of the weft thread is made possible.

Control arrangements according to the DE 1710292 A1 make possible a very reliable transfer of the weft thread at the machine center. However, there is still a desire for higher rotational speeds of such a gripper weaving machine.

In the prior art there are suggestions how one achieves a higher production capacity in that the thread clamps of the gripper heads are controlled in a contact-free manner by actuators according to various physical principles.

The GB 2 059 455 A proposes an arrangement of which the basic underlying functional principal exists in that an electrically controlled magnet acts on an arresting element in the gripper head, which releases the clamping lever or levers; which open or close under spring force.

The DE 102 52 053 A shows a spring-loaded clamping lever with arresting element, which is piezoelectrically released for opening the clamping lever.

In both mentioned cases, the clamping force of the thread clamps is not adjustable or adaptable to various yarn characteristics on a running machine.

EP 984089 A1 (there FIGS. 11 and 12) shows a system in which the adjustment of the clamping force of a thread clamp of a gripper head is achieved in a pneumatic manner on a running machine. For that, a bellows mounted on the gripper head is subjected to internal pressure. A control of the thread clamp at the machine center for transferring the weft thread from a bringer-gripper head to a taker-gripper head is, however, not possible with this embodiment.

An object of the present invention is to produce a gripper head of which the thread clamp for the weft thread can be controlled in a contact-free manner and with high transfer reliability of the weft thread even in the machine center.

The object is achieved by a gripper head as well as a gripper weaving machine with such a gripper head having the characteristic features of the independent claims.

A per se known thread clamp, which comprises a stationary clamping part and a movable clamping part, is mounted on a gripper head according to the invention for the insertion of weft threads on a gripper weaving machine. A first hollow body, of which the volume is enlarged under internal pressure of a gaseous and thus also compressible medium, is further mounted on the gripper head. Preferably, air is used as the medium. The first hollow body is connected with the movable clamping part in such a manner so that the variation or change of the volume of the hollow body exerts a force on the movable clamping part, which is referred to as a clamping part force in the following. Moreover, a return means is present on the gripper head and is likewise connected with the movable clamping part. The return means is preferably embodied as a spring. The return force of the return means is effective on the movable clamping part to oppose the clamping part force that is exerted on the movable clamping part by the volume enlargement of the first hollow body.

According to the invention, a second hollow body, in which an internal pressure of the same already mentioned medium can be produced, is mounted on the gripper head. For producing this internal pressure, means are provided with which an external force is exertable on the second hollow body in such a manner so that it achieves a variation, that is to say a reduction, of the volume of the second hollow body. A force effective in this manner is referred to as a control force in the following.

Moreover, a valve is mounted on the gripper head according to the invention. This valve is connected with the first and the second hollow body in such a manner so that a pressure equalization between the two hollow bodies can take place by opening the valve. Thereby the gaseous medium is directed from one to the other hollow body.

As long as the valve is closed, the gaseous medium cannot escape out of the first hollow body. An internal pressure present in the first hollow body and the clamping part force caused thereby are maintained. Moreover, a means for closing is mounted on the valve. By the closing means, a closing force is produced that opposes such forces by which the valve is opened. Preferably for that, a movable valve body is present in the valve, and for example a closing means embodied as a valve spring engages the movable valve body. Thereby the valve body is pressed against a valve seat, so that an opening through which the gaseous medium is guided through the valve remains closed.

In an advantageous embodiment of the inventive gripper head, a dimensioning of the closing means, for example a valve spring, that is to be suitably selected by the builder, serves to ensure that the valve remains closed as long as the pressure of the gaseous medium acting on the valve body does not exceed certain values. The closing means can also be embodied as an elastically deformable membrane in the valve.

According to the invention the valve is embodied in such a manner so that it is operable, that is to say openable or closable, by contact-free transmission of signals or forces.

An embodiment is preferred in which magnetic forces produced outside of the gripper head act on the valve body.

However, also conceivable are other more-complex valve systems, which are actuateable, for example, by high frequency electromagnetic radio signals.

The gripper head according to the invention can be embodied both as a bringer-gripper head as well as a taker-gripper head.

In an advantageous embodiment of the bringer-gripper head, the thread clamp is closed by the clamping part force that is exerted onto the movable clamping part by the first hollow body under internal pressure. The movable clamping part is pressed onto the stationary clamping part. When the clamping part force subsides, then the thread clamp is opened in this embodiment of the bringer-gripper head, because the return force that acts on the movable clamping part opposes the clamping part force.

In an embodiment as a taker-gripper head, it is shown to be advantageous when the return means, the movable clamping part and the first hollow body are arranged in such a manner so that the effect of the forces is reversed in comparison to the bringer-gripper head: the thread clamp is closed by means of the return force, in that the two clamping parts of the thread clamp are pressed against one another, and the thread clamp is opened by the clamping part force of the first hollow body.

In a further embodiment of the inventive gripper head, the application of the external control force on the second hollow body of the gripper head is achieved by means of a control lever. This is mounted on the gripper head in such a manner so that therewith control forces can be applied onto the second hollow body, which produce a reduction of its volume, thus internal pressure. The control lever can be supported articulately or elastically in the gripper head. In an advantageous manner, it can comprise a control surface via which a force can be applied onto the control lever from outside of the gripper head. The arrangement is configured so that this is also possible when the gripper head is in motion.

The inventive grippers are provided for use in a gripper weaving machine. In an advantageous further development of the invention, this gripper weaving machine includes a valve opening arrangement for the contact-free opening of the valve in the gripper head. For that, one or more actuators are provided. Therewith the valve mounted on the gripper head is operateable. According to the invention, an actuator is provided that does not come into contact with the gripper head during the operating of the valve. That can be an electromagnet, for example, which is activated as needed at certain time points in the weaving cycle by an electronic control of the gripper weaving machine. This can also take place during the movement of the gripper head through the loom shed of the gripper weaving machine. The actuator is advantageously mounted in the area of the running path of the gripper head, thus for example below the running path, over which also the warp threads are guided in the weaving machine. The mounting can be in the machine center but also outside of the woven web path or the loom shed at the sides of the machine. An opening and closing of the bringer-gripper head and the taker-gripper head during the thread transfer is possible by a suitable selection of the number and arrangement of the actuators.

Furthermore, the gripper weaving machine with inventive gripper heads includes at least one control arrangement with which a control force can be applied to the second hollow body via a control rail if applicable via a control lever at certain time points in the weaving cycle, whereby the reduction of the volume and therewith of the internal pressure in the second hollow body arises. This force can be previously set or specified by the structural embodiment or by adjustments by the operator. It can even be changeable during the weaving operation. For this purpose, in an advantageous embodiment of the invention, the control arrangement is equipped with electromechanical or pneumatic means for changing the control force or the control stroke.

The functional cooperation of the gripper weaving machine with the gripper heads will be explained in the following in an example of a bringer-gripper head. That is the gripper head that picks up the weft thread outside of the loom shed and brings it to the machine center of the gripper weaving machine, where the weft thread is transferred to a taker-gripper head.

In the weaving operation, when the bringer-gripper head in a position outside of the loom shed begins its motion in a direction toward the inlet side of the loom shed, the first hollow body for operating the movable clamping part is still without increased internal pressure and the movable clamping part is held open by the clamping positioning means.

In the position of the bringer-gripper head in which the weft thread is to be picked up, the control arrangement present on the gripper weaving machine is actuated in such a manner so that an internal pressure arises in the second hollow body on the bringer-gripper head.

Upon exceeding a certain value of this internal pressure, the valve is opened by the pressurized air compressed in the second hollow body opposing the closing force acting on the valve body.

The air compressed in the second hollow body flows through the valve and a pressurized air line into the first hollow body. Thereby an internal pressure arises therein, which enlarges the volume of the first hollow body, so that a force is exerted on the movable clamping part. This clamping part force leads to the movable clamping part being pressed onto the stationary clamping part against the return force of the return means, so that the weft thread is clamped by a holding force that results from the clamping part force and the return force. Next, the bringer-gripper head, by its forward motion, comes out of the working area or range of the control arrangement. Of course, the control arrangement can also be actuated in such a manner so that already previously no control force further acts on the second hollow body. In both cases, the second hollow body now becomes pressureless. The valve spring is dimensioned so that the valve remains closed and the internal pressure in the first hollow body is maintained for actuating the movable clamping part. Thus, the clamped weft thread can be transported to the position for thread transfer to the taker-gripper head at the machine center.

For transferring the weft thread to the taker-gripper head, the valve is opened by a further actuator mounted in the machine center. That occurs without contact between actuator and gripper head. Thus, no mechanical wear occurs between the participating components. The compressed air in the first hollow body for actuating the movable clamping part now escapes through the pressurized air line and the valve into the second hollow body that is pressureless at this time point. As a result of this, the movable clamping part is released from the stationary clamping part by the return force of the return means and the thread clamp is opened. The weft thread can now be taken over by the taker-gripper head. The bringer-gripper head thereafter moves with opened thread clamp out of the loom shed and the weaving cycle is repeated.

There are also machine embodiments in which the bringer-gripper head does not transfer the weft thread to a taker-gripper head, but rather transports it through the entire loom shed. The described process is then usable in the same sense. In such a case, the actuator of the valve opening arrangement is not mounted in the machine center but rather on the outlet side of the loom shed of the gripper weaving machine.

In further embodiments of the invention, the return means can be embodied, for example, as a tension spring, as a compression spring or as a bending spring. Pneumatic or magnetically effective spring elements as well as combinations of springs and magnets are also conceivable as embodiments of the return means.

The production of the control force by the control arrangement can, for example, also be achieved via a stationary slide block guide or control rail. In that regard, the second hollow body and/or the control lever in the gripper head comprise a corresponding control or butting run-up surface, which abuts and runs against the stationary control rail during the motion of the gripper head, so that a force is exerted from the control rail onto the butting run-up surface, without an actively controlled motion of the control rail in the direction toward the gripper head taking place.

The hollow bodies, of which the volume changes are in relation to a force effective from or to the outside, are preferably embodied as an expandable bellows or also as a pneumatic cylinder. When using an expandable bellows as a hollow body, this bellows through its elasticity usually already includes a return means, which applies a return force via the contact surface between bellows and movable clamping part. However, a return spring as a separate component can also be integrated in the bellows or in the pneumatic cylinder.

Instead of electronically actuated electromagnets, stationary permanent magnets can also be used as actuators, which open the valve in the gripper head at the time point at which the gripper head is moved past these magnets. A combination of permanent magnet and electrically actuateable magnetic coil is also possible.

In the following the invention is explained in detail in connection with example embodiments.

FIG. 1 Perspective view of a first embodiment of the gripper head according to the invention as a bringer-gripper head with valve opening arrangement and control arrangement.

Figure 2:
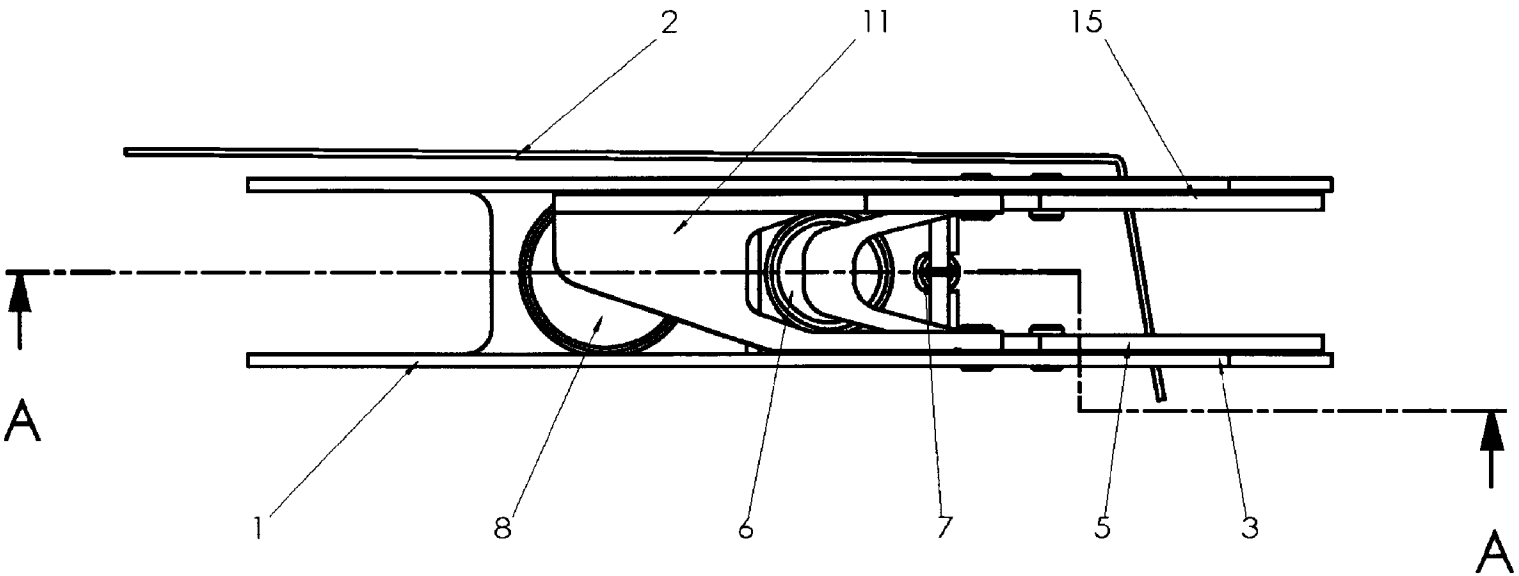

FIG. 2 View from the top of the embodiment according to FIG. 1.

Figure 3:
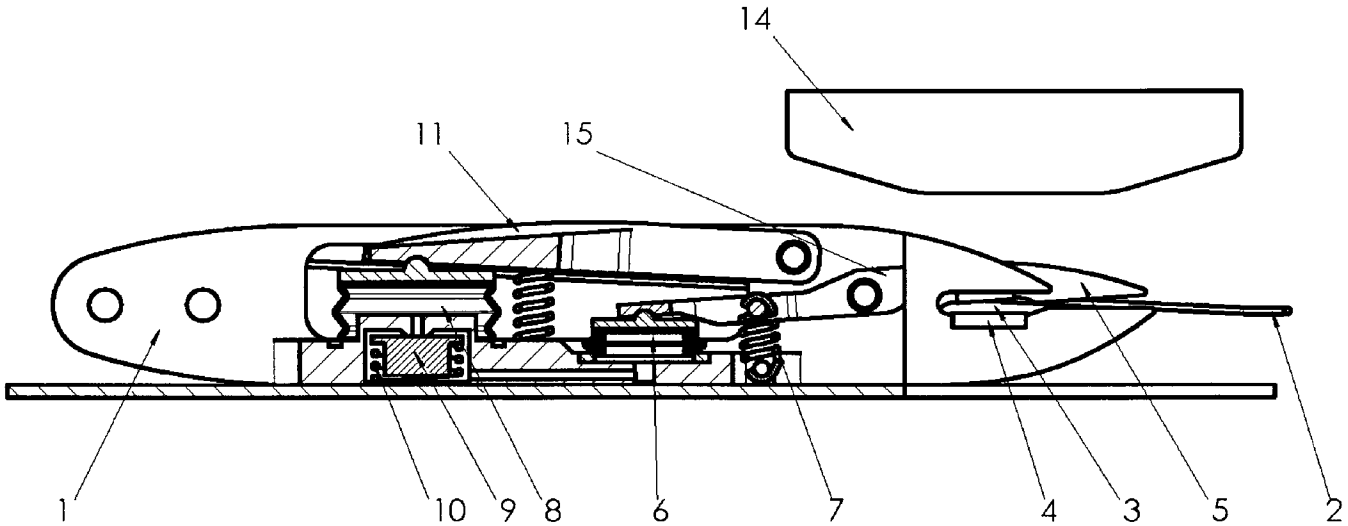

FIG. 3 Sectional view A-A of the embodiment according to FIG. 1, opened thread clamp, position of the gripper head outside of the loom shed.

Figure 4:
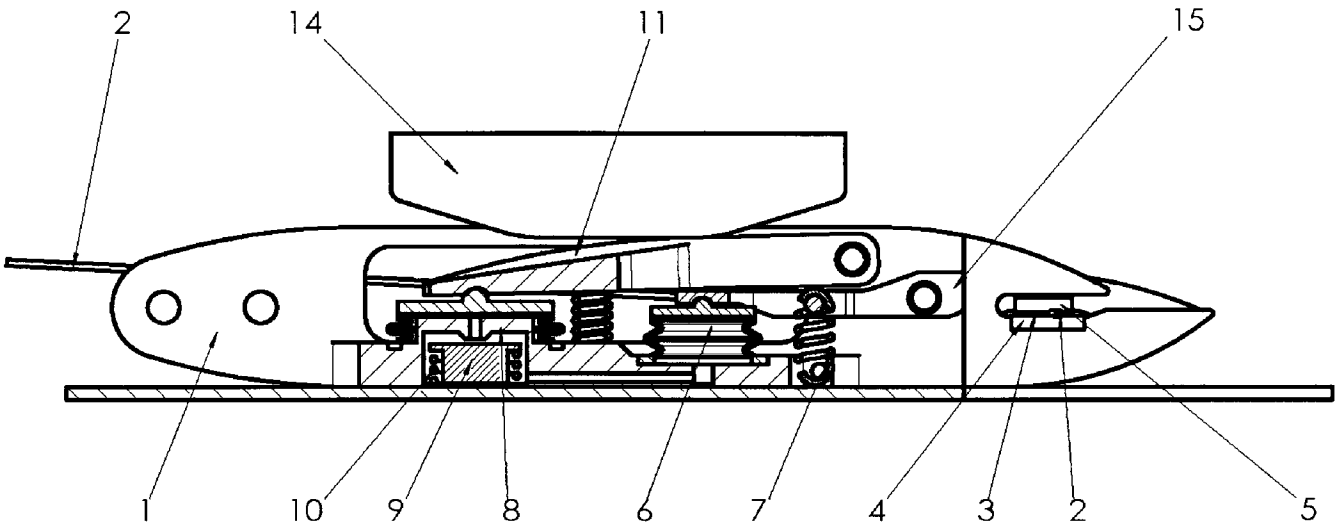

FIG. 4 Sectional view according to FIG. 3, actuation by control arrangement, thread clamp closed.

Figure 5:
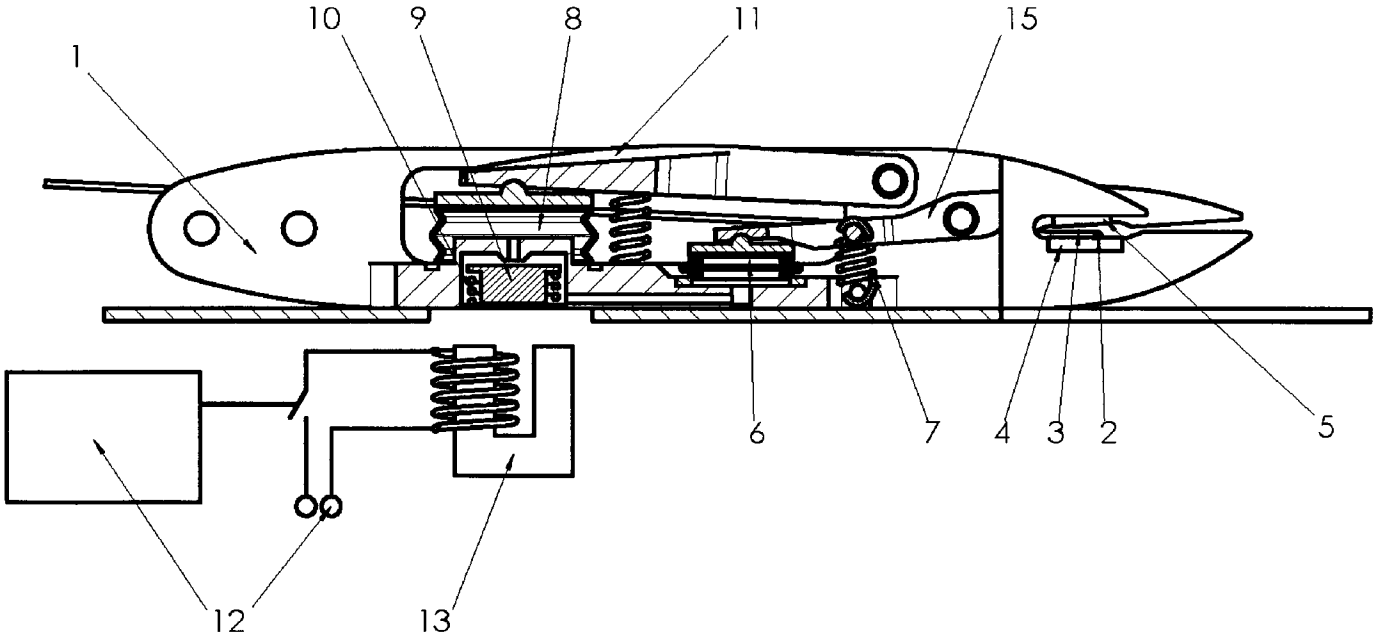

FIG. 5 Sectional view of the embodiment according to FIG. 1, gripper head in machine center, valve opened by valve opening arrangement, thread clamp opened.

Figure 6:
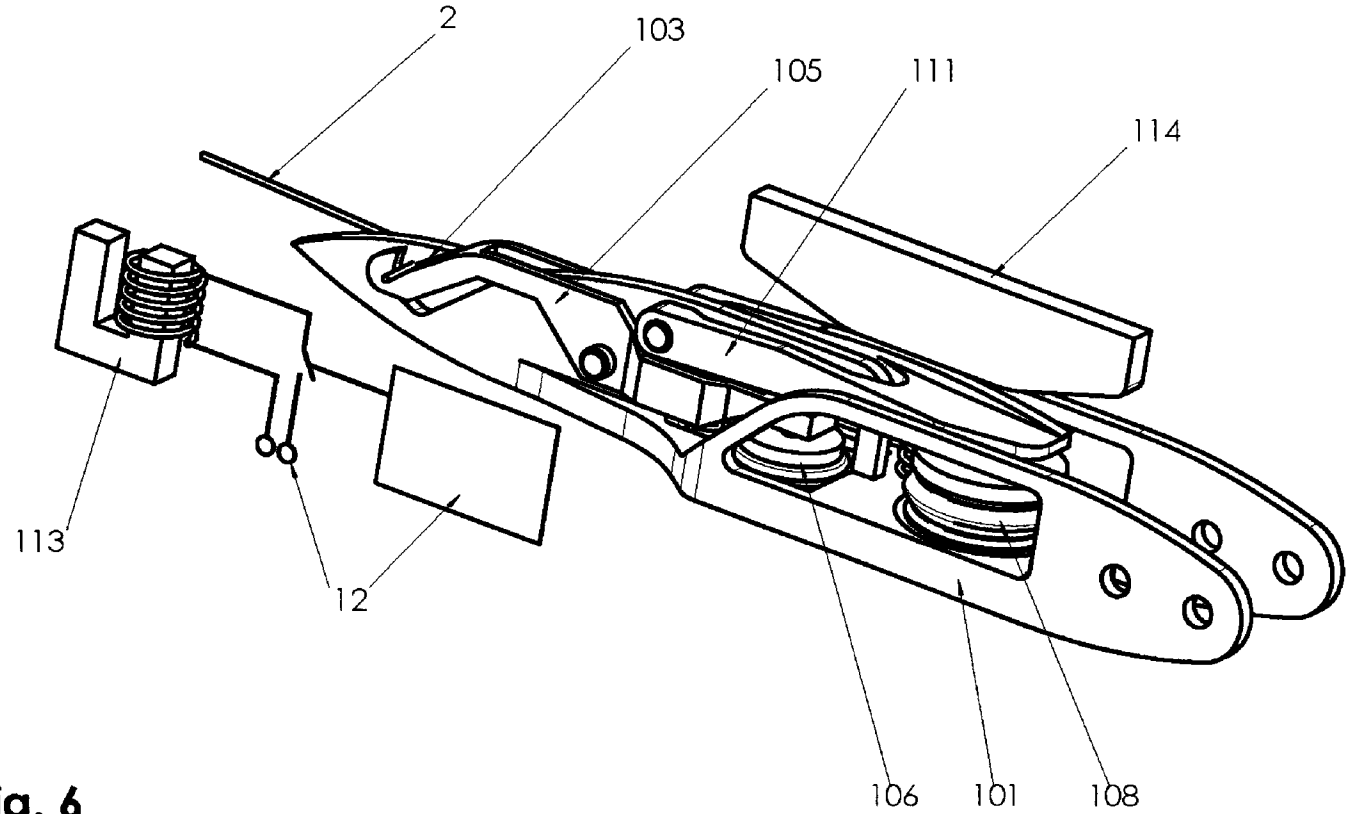

FIG. 6 Perspective view of an embodiment of the gripper head according to the invention as a taker-gripper head with valve opening arrangement and control arrangement.

Figure 7:
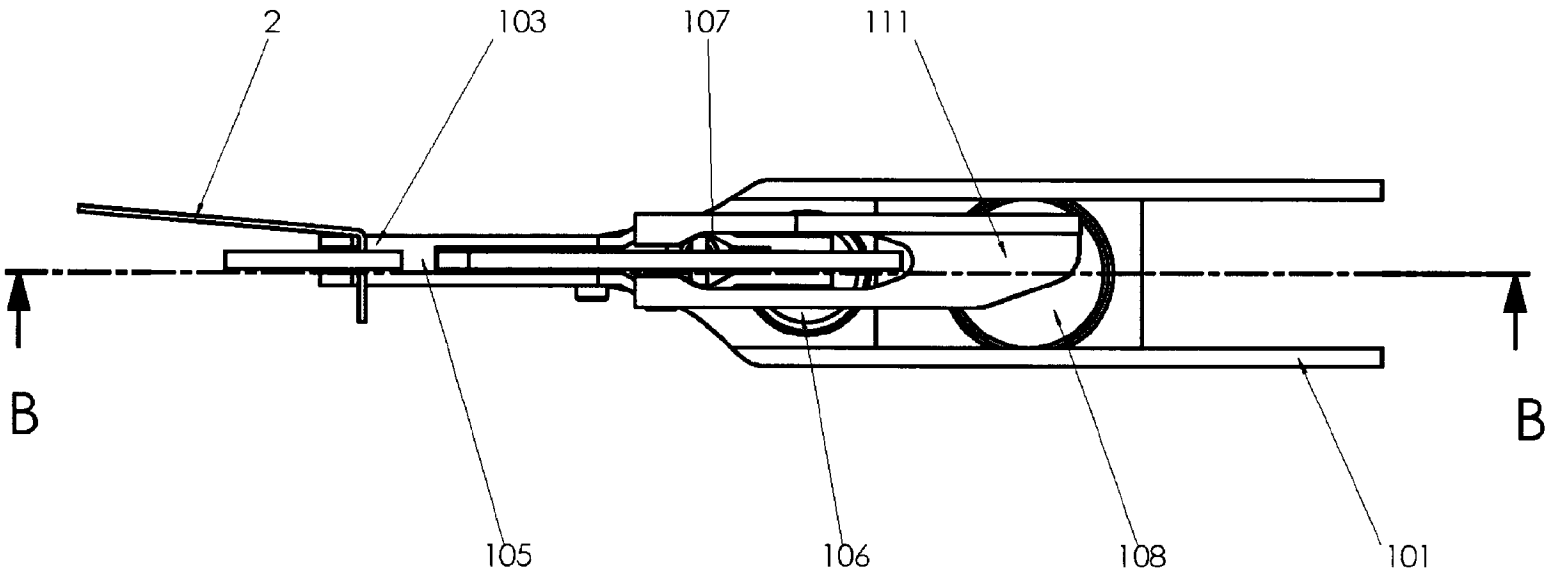

FIG. 7 View from the top of the embodiment according to FIG. 6.

Figure 8:
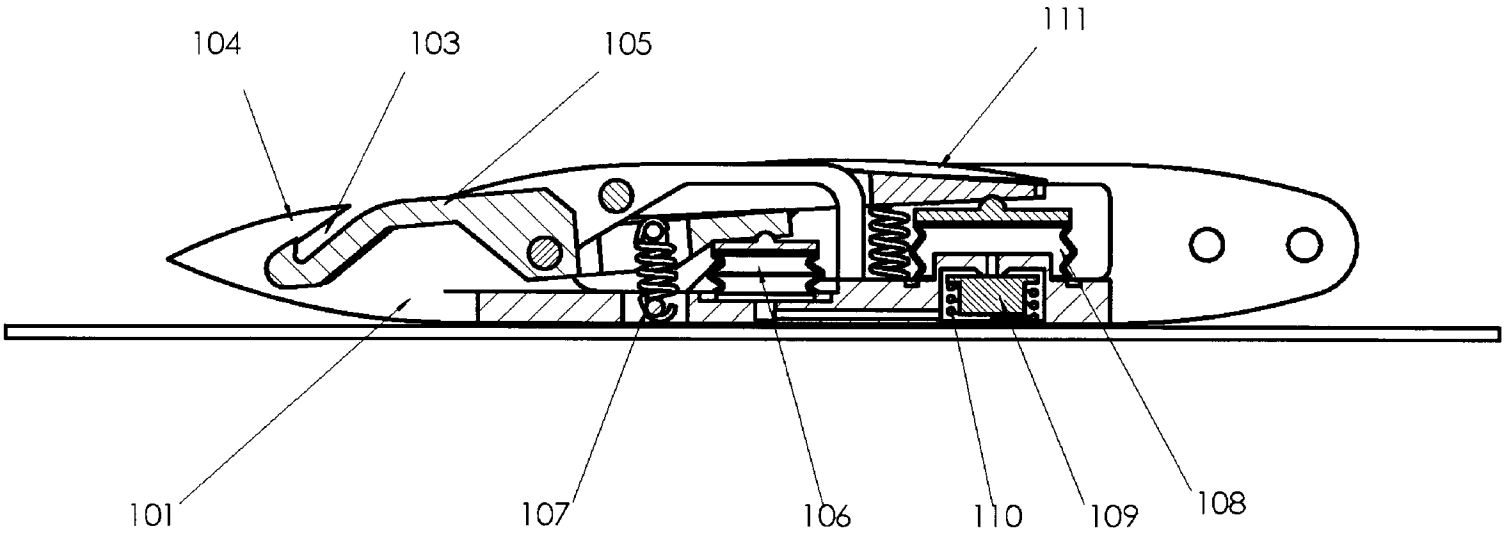

FIG. 8 Sectional view B-B of the embodiment according to FIG. 6, gripper head in the loom shed, thread clamp opened.

Figure 9:
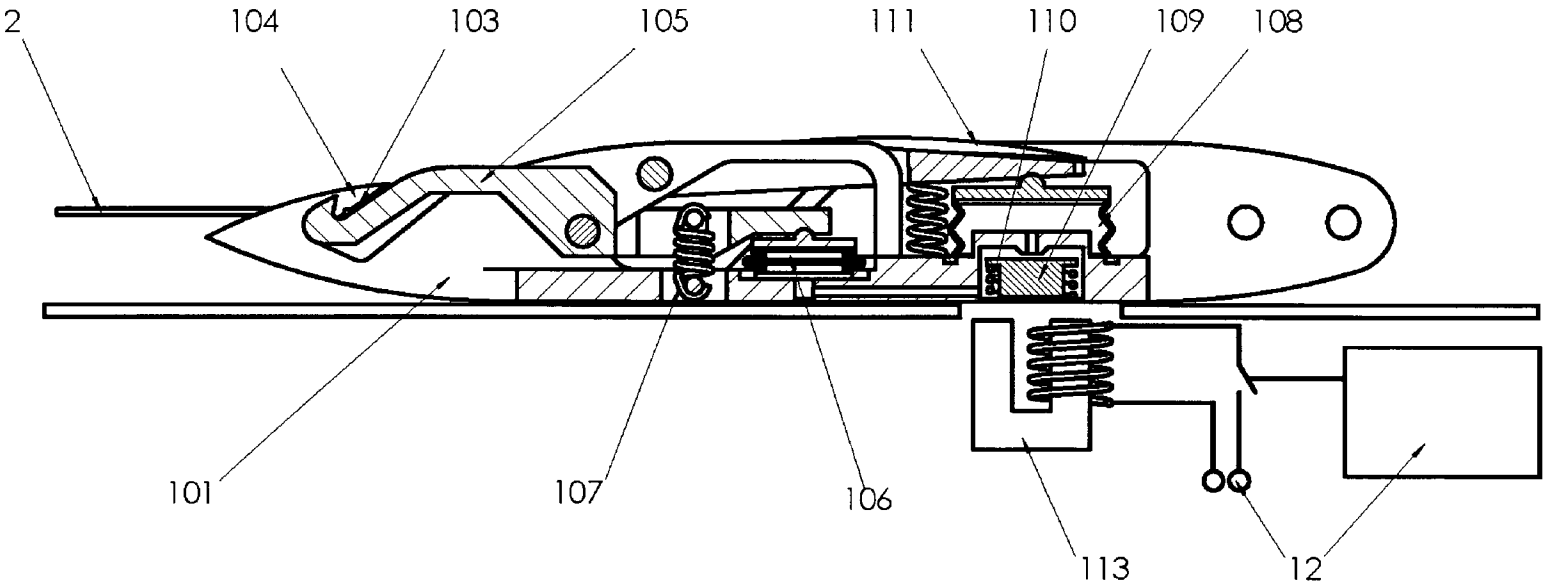

FIG. 9 Sectional view of the embodiment according to FIG. 6, gripper head in machine center, valve opening arrangement opens valve, thread clamp closes.

Figure 10:
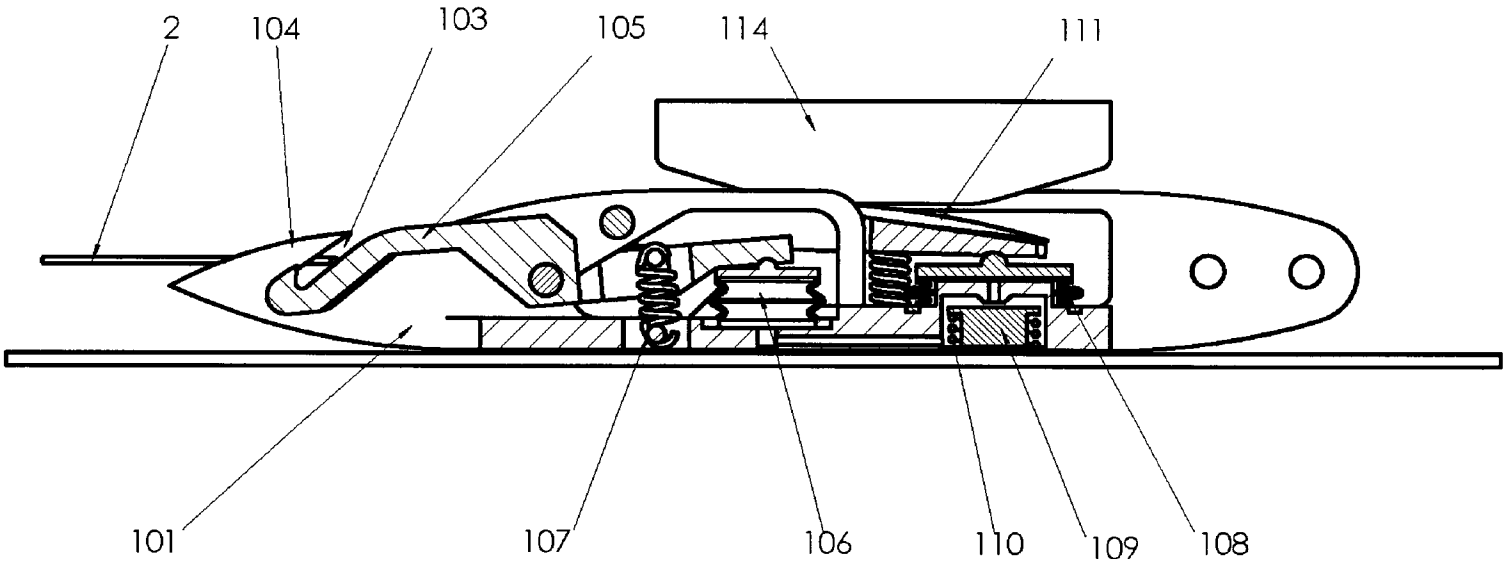

FIG. 10 Sectional view of the embodiment according to FIG. 6, gripper head in position outside of the loom shed, with control arrangement, thread clamp opens.

Figure 11:
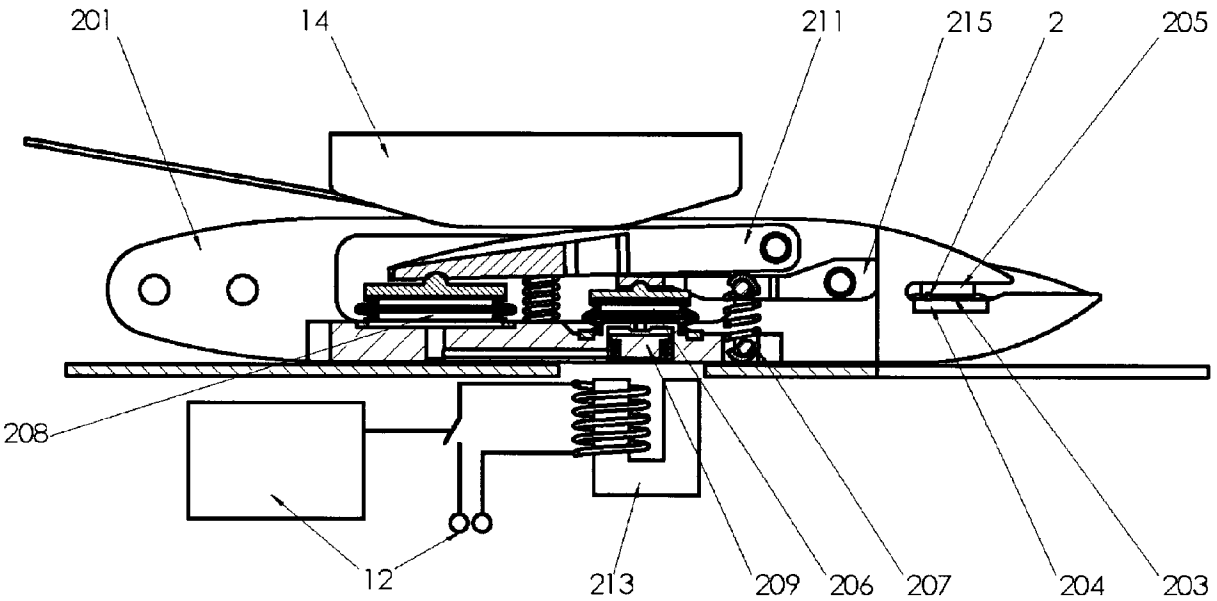

FIG. 11 Sectional view of a further embodiment of the bringer-gripper head with other valve arrangement; bringer-gripper head in outside position at thread pick-up, thread clamp closes.

Figure 12:
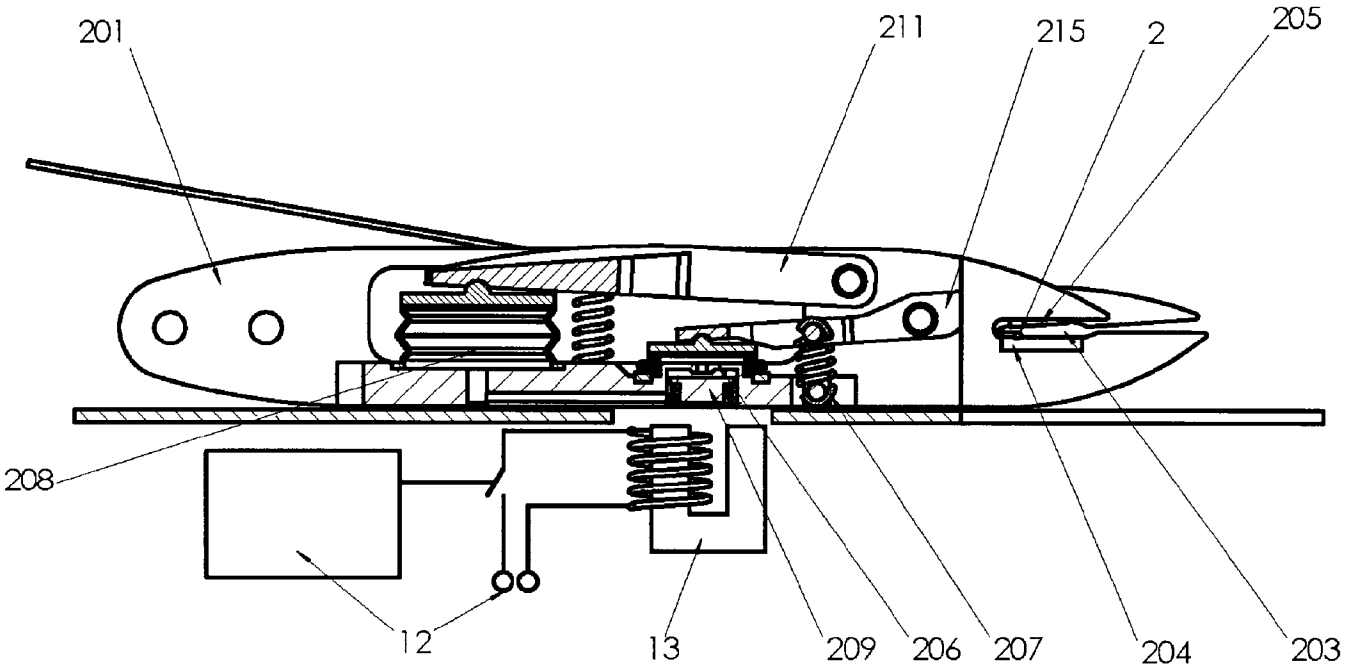

FIG. 12 Further sectional view of the embodiment according to FIG. 11; bringer-gripper head in machine center at transfer to taker-gripper head; actuator opens valve; return spring opens thread clamp.

The FIGS. 1 to 3 show various different views of a first embodiment of the inventive gripper head as a bringer-gripper head 1. This picks up the weft thread 2 outside of the loom shed and carries it to the machine center. The bringer-gripper head 1 consists of a base body in the form of a U-profile member. For securing the U-profile member, for example to a gripper rod or rapier, bored holes are provided on one end of the base body, which are used for a screwed connection. The stationary clamping part 4 of a thread clamp 3 as well as a guide contour for the weft thread 2 are located at the other end of the base body. When picking up a weft thread 2, a weft thread section or segment is formed between thread clamp 3 and guide contour. The movable clamping part 5 of the thread clamp 3 is embodied as a clamping lever with two lever arms. A rotation axis by which the movable clamping part 5 is rotatably supported in the base body, is located between the two lever arms. A clamping jaw is mounted in a known manner on the front lever arm, which lies closer to the gripper tip or point, of the movable clamping part 5. Depending on the weft thread type, of course, embodiments without a clamping jaw are also possible. A contact surface, by which the movable clamping part 5 is connected with a first hollow body 6, is located on the rear lever arm, which faces away from the gripper tip, of the movable clamping part 5. This hollow body 6 is embodied as an expandable bellows, which is mounted on the base body of the bringer-gripper head 1.

In order to clamp the weft thread 2 between the movable clamping part 5 and the stationary clamping part 4, the movable clamping part 5 is pivoted about its rotation axis in the clockwise direction. This occurs by a force that acts from the bellows 6 onto the lever arm that faces away from the gripper tip of the movable clamping part 5.

During the transport of the weft thread 2 into the loom shed of the gripper weaving machine, the weft thread 2 is held in the bringer-gripper head 1 in the thread clamp 3 and in the already mentioned guide contour. The guide contour, which is opened toward the tip of the bringer-gripper head 1, is covered toward the tip by a cover lever 15 during the movement of the gripper through the loom shed. Thereby it is prevented that warp threads, which extend in the loom shed perpendicularly to the running direction of the bringer-gripper head 1, are grasped in an undesired manner by the guide contour. However, in order that the weft thread 2 to be inserted can be grasped by the guide contour in the desired manner in the position of the bringer-gripper head 1 outside of the loom shed, the cover lever 15 is supported rotatably in the base body. In the present example embodiment, the rotation axis is congruent with the rotation axis of the movable clamping part 5. Movable clamping part 5 and cover lever 15 are connected with one another so that a rotation motion of the movable clamping part 5 also causes a rotation motion of the cover lever 15.

The upper end of a return spring 7 acting as a return means is secured on a connection web between the cover lever 15 and the lever arm of the movable clamping part 5 facing away from the gripper tip. The lower end of the return spring 7 is mounted on the base body of the bringer-gripper head 1. The return spring 7 is pre-stressed in tension, so that the movable clamping part 5 together with the cover lever 15 are turned counterclockwise and thereby the thread clamp 3 is opened, without effect of further forces. The thread clamp 3 will be closed only when the clamping part force that acts from the bellows 6 onto the movable clamping part 5 exerts thereon a greater torque than the spring force of the return spring 7.

In the present example embodiment, the expandable bellows 6 is mounted in the front half of the bringer-gripper head 1 that faces toward the gripper tip. On its upper end, this bellows 6 comprises a contact surface to the movable clamping part 5. The lower end is secured on the base body of the bringer-gripper head 1 and comprises a pressurized air opening through which pressurized air can be introduced into the bellows 6. By means of the introduction of pressurized air, an internal pressure is produced in the bellows 6, which leads to a volume enlargement of the bellows 6. This volume enlargement causes the clamping part force that is exerted from the bellows 6 onto the lever arm of the movable clamping part 5 embodied as a clamping lever.

In the present example embodiment, a pressurized air line is provided in order to introduce pressurized air into the first bellows 6. This pressurized air line connects the first bellows 6 with the inventive second hollow body 8. This second hollow body 8 is similarly embodied as an expandable bellows. This is mounted in the rear half of the bringer-gripper head 1 facing away from the gripper tip, and similarly comprises a contact surface on the top side and a pressurized air opening on the bottom side.

A valve 9 is provided between the pressurized air opening of the second bellows 8 and the pressurized air line, through which valve, in the opened condition, a connection is established between the two hollow bodies 6, 8 in such a manner so that pressurized air can flow over from one into the other hollow body.

In the present example, the valve 9 is embodied as a non-return or check valve, which consists of a valve body and a valve spring 10 acting as a closing means. These elements are arranged in a valve housing that guides or conveys pressurized air. The valve housing is connected with the base body of the bringer-gripper head 1. The valve body is vertically movable in the valve housing. The valve spring 10 is mounted and pre-stressed in such a manner so that the closing force of the valve spring presses the valve body with its upper bounding surface against the outlet of the pressurized air opening at the lower end of the second bellows 8; thereby the valve 9 is held closed.

The contact surface on the top side of the second bellows 8 is connected with the one end of a control lever 11, of which the other end is supported in the bringer-gripper head 1. In the present example, this support is achieved via a rotation axis in the forward half of the bringer-gripper head 1. On a top side, the control lever 11 comprises a control surface, by which a force and therewith a rotational movement in the counter-clockwise direction can be applied to the control lever 11 from outside of the bringer-gripper head 1 by means of elements of the control arrangement. A control lever spring is mounted on the base body of the bringer-gripper head 1 under the control lever 11. In the pre-stressed condition, the spring force of this control lever spring causes a rotational motion of the control lever 11 in the clockwise direction. In a different embodiment, the control lever spring could also be arranged within the second bellows 8 in such a manner that it upwardly presses the upper contact surface with the end of the control lever 11. Thereby the control lever and the second bellows 8 are re-set or returned. At this point, it is of course also conceivable to provide means for re-setting or returning that are embodied analogously to the various different embodiment possibilities of the return means 7 for the movable clamping part 5 as discussed further above.

In the view of the FIG. 3, the position of the bringer-gripper head 1 outside of the loom shed is illustrated together with a control element, e.g. a control rail 14 of the control arrangement. There is not yet any contact between bringer-gripper head 1 and control rail 14.

The spring force of the control lever spring acts to oppose a pressing-together of the second bellows 8. The second bellows 8 is internally more or less pressureless or has the ambient pressure. The first bellows 6 is also pressureless and is therefore pressed together by the return spring 7 and the movable clamping part 5; its volume is reduced. In this condition, the thread clamp 3 and the cover lever 15 are opened. The weft thread 2 to be inserted next, is presented to the bringer-gripper head 1 transversely to the motion direction of the gripper by a typical selector arrangement of a gripper weaving machine. Upon a forward motion of the bringer-gripper head 1 in a direction toward its tip, i.e. in a direction toward the loom shed, the presented weft thread 2 is grasped by the thread clamp 3 and by the guide contour. The thread clamp 3 must now be closed.

This is shown in FIG. 4. In its forward motion in the direction toward the loom shed, the bringer-gripper head 1 comes into the operating range of the control rail 14 of the control arrangement. The control rail 14 is moved vertically downwardly. For that, there is provided a drive, which is not further shown, and which can consist of a cam disc and a roller lever guided thereon for example. The cam disc is driven by the main drive of the weaving machine.

Of course, arrangements are also conceivable, in which the cam disc is driven by its own motor. By changing the lever arm on the roller lever as well as by securing the control rail 14, e.g. via slotted holes, the stroke and position of the control rail 14 with respect to the gripper head can be adjusted. However, also possible are embodiments with a linear drive or pneumatic cylinder, in which the control rail 14 is linearly positionable in the direction toward the gripper head in a freely programmable manner.

During its vertical motion, the control rail 14 of the control arrangement comes into contact with the control lever 11 and via this control lever presses the second bellows 8 together. The volume of the bellows 8 is reduced and the air present in it is compressed. An increased internal pressure arises in the bellows 8. Upon exceeding a certain internal pressure, the valve body is pressed downwardly against the valve spring force; the valve 9 opens. Thereby the compressed air is guided or conducted via the pressurized air line to the first bellows 6. As a result of this, the first bellows 6 is subjected to an increased internal pressure, its volume enlarges, and with sufficient internal pressure the clamping part force becomes so large that the movable clamping part 5 and the cover lever 15 are moved against the spring force of the return spring 7, whereby the thread clamp 3 closes and clamps the weft thread 2.

Then the bringer-gripper head 1 is moved in a known manner through the loom shed formed by warp threads to the machine center of the gripper weaving machine. There the thread clamp 3 must be opened so that the weft thread 2 can be transferred to the taker-gripper head 101.

This process is illustrated in FIG. 5. The illustrated embodiment of the gripper weaving machine with inventive gripper heads (1, 101) comprises a valve opening arrangement 12 for the operation of electromagnetic actuators 13. A first one of such actuators 13 is illustrated in FIG. 5 below the bringer-gripper head 1. A second actuator 113 is similarly mounted below the taker-gripper head 101 for the operation of the taker-gripper head 101 as will be described later.

The actuators 13, 113 are arranged approximately in the machine center below the running path of the gripper heads 1, 101 and integrated in the running path in such a manner so that the warp threads can be lead or guided through without damage between gripper head bottom sides and the gripper running path. In the motion direction of the gripper heads the arrangements of the actuators 13, 113 are structurally selected in such a manner so that the function of the thread transfer between bringer- and taker-gripper head 1, 101 can be surely or reliably carried out.

In FIG. 5 it is illustrated that the bringer-gripper head 1, in its motion in the area of the machine center, has reached the position of the first actuator 13. Through a control pulse of the valve opening arrangement 12, the actuator 13 is operated in such a manner so that a magnetic actuator force acts in a contact-free manner on the valve 9 in the bringer-gripper head 1. Thereby the valve 9 is opened. The spring force of the return spring 7 presses the first bellows 6 together. The compressed air flows via the valve 9 into the second bellows 8 and the thread clamp 3 opens. Because the cover lever 15 simultaneously swings or pivots upwardly, the weft thread 2 is free and can be grasped and further transported by the taker-gripper head 101.

The construction of a second embodiment of the inventive gripper head, namely a taker-gripper head 101, is illustrated in the FIGS. 6 to 8.

In its rear half facing away from the gripper tip, the taker-gripper head 101 comprises a U-shaped shape with bored securing holes. In the front half, however, the taker-gripper head 101 comprises a single tip or point with a thread clamp 103. No guide contour and no cover lever 15 are present, because no weft thread section must be formed in the taker-gripper head 101. In principle, the taker-gripper head 101 is constructed the same as the bringer-gripper head 1, but the thread clamp 103 is closed by the return spring 107 and the thread clamp 103 is opened by increased internal pressure in the first expandable bellows 106 for the operation or actuation of the movable clamping part 105. The movable clamping part 105 has a fork shape, whereby through this fork shape the movable clamping part 105 laterally surrounds or encloses the gripper tip with the stationary clamping part 104. Thereby, the stationary clamping part 104 is located on the bottom side of a hook tip or point facing away from the gripper tip. The thread clamp 103 closes by an upward motion of the movable clamping part 105.

The control lever 11 is also embodied with a fork shape in the front half facing toward the gripper tip, while it comprises a control surface on the rear half.

The first and the second hollow body 106, 108, the valve 109 and the return spring 107 are arranged similarly in the taker-gripper head 101 as in the bringer-gripper head 1.

In FIG. 8, the taker-gripper head 101 is illustrated with opened thread clamp 103. In that regard, the first bellows 106 is under internal pressure. The valve 109 with valve spring 110 is closed.

With opened thread clamp 103, the taker-gripper head 101 moves into the loom shed into the thread transfer position in order to take over the next weft thread 2 from the bringer-gripper head 1.

FIG. 9 shows that, for the transfer of the weft thread 2, the valve 109 is opened by a second electromagnetic actuator 113 mounted below the taker-gripper head 101. The air compressed in the first bellows 6 escapes via the pressurized air line and the valve 109 into the second expandable bellows 8. The movable clamping part 105 is closed by the return spring 107. The weft thread 2 is now clamped by the thread clamp 103 of the taker-gripper head 101. The taker-gripper head 101 is now moved out of the loom shed with closed thread clamp 103.

Outside of the loom shed the taker-gripper head 101 comes into the working area or range of a further control arrangement, which is constructed analogously to the control arrangement of the bringer-gripper head 1. This is illustrated in FIG. 10. An increased internal pressure is produced in the bellows of the second hollow body 108 on the taker-gripper head 101 by the control rail 114 via the control lever 111. Through the increased pressure, the valve 109 is opened and the compressed air flows into the first bellows 6. This causes the thread clamp 103 to be opened and the weft thread 2 to be released.

Next, the weft thread 2 is beat-up against the woven fabric edge by the weaving reed arrangement of the gripper weaving machine, and the described processes for the weft insertion begin anew.

A third embodiment of the inventive gripper head as a bringer-gripper head 201 is illustrated in the FIGS. 11 and 12. Therein, the valve 209 is mounted below the first bellows 206 and not below the second bellows 208. The arrangement according to FIGS. 11 and 12 has as a result, that with respect to the valve 209, a reversed operating or effective direction of the internal pressure arises in the two hollow bodies 206, 208. In this third embodiment, an increased internal pressure in the first bellows 206 acts opposite the return force in the valve 209. Except for this difference, the functional operation is similar as in the first embodiment. However, an additional actuator 213 is necessary for closing the thread clamp 203 in the position of the bringer-gripper head 201 outside of the loom shed, because the valve 209 in this arrangement cannot be opened by overpressure in the second bellows 208.

FIG. 11 shows the production of an overpressure in the second elastically deformable bellows 208 by means of control lever 211 and the subsequent closing of the thread clamp 203 through operation of the actuator 13 during the thread pick-up. FIG. 12 shows the opening of the thread clamp 203 of the bringer-gripper head 201 according to the third embodiment in the machine center by operation of the actuator 13 and the effect of the return spring 207 in the machine center.

REFERENCE CHARACTERS

1, 101, 201 gripper head
2 weft thread
3, 103, 203 thread clamp
4, 104, 204 stationary clamping part
5, 105, 205 movable clamping part
6, 106, 206 first hollow body
7, 107, 207 return spring
8, 108, 208 second hollow body
9, 109, 209 valve
10, 110 valve spring
11, 111, 211 control lever
12 valve opening arrangement
13, 113, 213 actuator
14, 114 control rail
15 cover lever

The invention claimed is:

1. Gripper head (1, 101, 201) usable for the insertion of weft threads (2) on a gripper weaving machine with a thread clamp (3, 103, 203) mounted on the gripper head (1, 101, 201), which thread clamp comprises a stationary clamping part (4, 104, 204) and a movable clamping part (5, 105, 205), whereby the movable clamping part (5, 105, 205) is pressable against the stationary clamping part (4, 104, 204) by means of a force, furthermore with a first hollow body (6, 106, 206) mounted on the gripper head (1, 101, 201), the volume of which is enlargeable under internal pressure of a gaseous medium, whereby the first hollow body (6, 106, 206) is connected with the movable clamping part (5, 105, 205) in such a manner so that through the volume enlargement of the first hollow body (6, 106, 206) a clamping part force is producible, which acts on the movable clamping part (5, 105, 205), furthermore with a valve (9, 109, 209) mounted on the gripper head (1, 101, 201), which is connected with the first hollow body (6, 106, 206) in such a manner so that the gaseous medium is conveyable through the valve (9, 109, 209) into the first hollow body (6, 106, 206), characterized in that a return means (7, 107, 207) is present on the gripper head (1, 101, 201), which is connected with the movable clamping part (5, 105, 205) in such a manner so that a return force acting through the return means (7, 107, 207) on the movable clamping part (5, 105, 205) opposes the clamping part force, and that a second hollow body (8, 108, 208) is mounted on the gripper head (1, 101, 201), in which an internal pressure of a gaseous medium is producible in that an external control force is applied onto this second hollow body (8, 108, 208), which causes a reduction of the volume of the second hollow body (8, 108, 208), and that the valve (9, 109, 209) is connected with the first and second hollow body (6, 8, 106, 108, 206, 208) in such a manner so that with opened valve (9, 109, 209) an exchange of the gaseous medium between the two hollow bodies (6, 8, 106, 108, 206, 208) takes place, while with closed valve (9, 109, 209) the gaseous medium cannot escape out of the first hollow body (6, 106, 206), and that a closing means (10, 110) is mounted on the valve (9, 109, 209) in such a manner so that a closing force caused by the closing means (10, 110) opposes such forces by which the valve (9, 109, 209) is opened, and that the valve (9, 109, 209) is embodied in such a manner so that it is actuatable by contact-free transmission of signals or forces.

2. Gripper head (1, 201) according to claim 1, characterized in that the movable clamping part (5, 205) is pressed against the stationary clamping part (4, 204) by means of the clamping part force.

3. Gripper head (101) according to claim 1, characterized in that the movable clamping part (105) is pressed against the stationary clamping part (104) by means of the return force.

4. Gripper head (1, 101, 201) according to claim 1, characterized in that at least one of the two hollow bodies (6, 8, 106, 108, 206, 208) is embodied as an expandable bellows or as a pneumatic cylinder.

5. Gripper head (1, 101, 201) according to claim 1, characterized in that the return means (7, 107, 207) is embodied as a permanent magnet, as a spring, or as a combination of both.

6. Gripper head (1, 101, 201) according to claim 1, characterized in that the movable clamping part (5, 105, 205) is embodied as a clamping lever, that is rotatably supported in the gripper head (1, 101, 201) about an axis, and that the return force opposes a rotation of the movable clamping part (5, 105, 205) about this axis.

7. Gripper head (1, 101, 201) according to claim 1, characterized in that the closing means (10, 110) is embodied as a valve spring, which is dimensioned in such a manner so that the valve (9, 109, 209) remains closed up to a prescribed pressure of the gaseous medium opposing the closing force.

8. Gripper head (1, 101, 201) according to claim 1, characterized in that a control lever (11, 111, 211) is movably mounted on the gripper head (1, 101, 201), which control lever is operatively connected with the second hollow body (8, 108, 208) in such a manner so that by means of the control lever (11, 111, 211) an external control force can be applied onto the second hollow body (8, 108, 208) in such a manner so that a reduction of the volume of the second hollow body (8, 108, 208) is caused.

9. Gripper head (1, 101, 201) according to claim 8, characterized in that the control lever (11, 111, 211) is rotatably supported in the gripper head (1, 101, 201) about an axis, and that a control lever spring is present, which opposes the control force.

10. Gripper weaving machine with at least one gripper head (1, 101, 201) according to claim 1, characterized in that a valve opening arrangement (12) is present, which comprises at least one actuator (13, 113, 213), which is mounted in the area of the running path of the gripper head (1, 101, 201), so that an actuator force can be applied onto the valve (9, 109, 209) in a contact-free manner in such a manner so that this valve is opened, and in that a control arrangement is present, with which an external control force can be applied onto the second hollow body (8, 108, 208) in a position of the gripper head (1, 101, 201) outside of the loom shed formed by warp threads, in such a manner so that a reduction of the volume of the second hollow body (8, 108, 208) is caused.

11. Gripper weaving machine according to claim 10, characterized in that the actuator (13, 113, 213) is a controllable electromagnet, a permanent magnet, or a combination of both.

12. Gripper weaving machine according to claim 10, characterized in that the control arrangement comprises at least one cam disc, a roller lever driven by the cam disc, and a control rail (14, 114), wherein the cam disc is connected with the main drive of the weaving machine, and wherein the connection between the control rail (14, 114) and the roller lever is embodied in such a manner so that the position and/or the magnitude of the motion stroke of the control rail (14, 114) in the direction toward the gripper head (1, 101, 201) are adjustable by the operator.

13. Gripper weaving machine according to claim 10, characterized in that the control arrangement comprises at least one electromechanically or pneumatically driven control rail (14, 114), wherein the position and/or the magnitude of the motion stroke of the control rail (14, 114) in the direction toward the gripper head (1, 101, 201) are freely programmable via electronic means of the control arrangement for various different time points in the weaving cycle.

14. Gripper weaving machine according to claim 10, characterized in that two gripper heads (1, 101, 201) are present, and in that respectively one control arrangement is allocated to each one of the two gripper heads in the position outside of the loom shed, and in that at least one actuator (13, 113) of the valve opening arrangement (12) is allocated to each one of the two gripper heads in the area of the machine center.

15. Gripper weaving machine according to claim 14, characterized in that at least one further actuator (213) is allocated to at least one of the two gripper heads (201) in a position outside of the loom shed.

* * * * *